US007445113B2

(12) United States Patent
Wilhelm

(10) Patent No.: US 7,445,113 B2
(45) Date of Patent: Nov. 4, 2008

(54) SYSTEM FOR STORING, ORGANIZING AND CATALOGUING PAINT

(76) Inventor: Timothy G. Wilhelm, 4101 Bounce Dr., Orlando, FL (US) 32812-8147

( * ) Notice: Subject to any disclaimer, the term of this patent is extended or adjusted under 35 U.S.C. 154(b) by 357 days.

(21) Appl. No.: 11/117,165

(22) Filed: Apr. 28, 2005

(65) Prior Publication Data

US 2006/0243605 A1 Nov. 2, 2006

(51) Int. Cl.
*B44D 3/04* (2006.01)

(52) U.S. Cl. ..... 206/1.8; 206/361; 206/557

(58) Field of Classification Search ..... 206/1.8, 206/575, 576, 203, 427, 193, 361, 362, 520, 206/557

See application file for complete search history.

(56) References Cited

U.S. PATENT DOCUMENTS 1,761,787 A * 6/1930 Gorman, Jr. ..... 53/416
2,040,209 A * 5/1936 Levyne ..... 206/446
3,278,007 A * 10/1966 Weber ..... 206/1.8
3,991,879 A * 11/1976 Hirota ..... 206/203
4,895,256 A * 1/1990 Johnston ..... 206/501
5,803,264 A * 9/1998 Gersten et al. ..... 206/549
2005/0087466 A1* 4/2005 Davis ..... 206/427
2005/0092640 A1* 5/2005 Woodward ..... 206/427
2006/0054527 A1* 3/2006 Hart et al. ..... 206/459.5

* cited by examiner

*Primary Examiner*—David T Fidei
(74) *Attorney, Agent, or Firm*—Timothy H. Van Dyke; Beusse Wolter Sanks Mora & Maire

(57) ABSTRACT

Disclosed herein is a novel paint storage, organizing and cataloguing system. The system comprises a tray that holds two or more containers of paint. The containers of paint comprise a form secured thereto for recording useful cataloguing information. In addition, disclosed herein is a method of promoting products or services, especially those related to home repair, building, remodeling and maintenance, that includes the provision of marketing information on the side of a tray especially designed for holding paint containers.

9 Claims, 4 Drawing Sheets

SYSTEM FOR STORING, ORGANIZING AND CATALOGUING PAINT

BACKGROUND

In the U.S., new home construction has steadily increased over the last three decades. A large portion of these new homes possess a painted exterior, as well as painted interior walls. It is a common fact that paint is dramatically prevalent in modem society. After a new home is built, and exteriors and interiors are painted, there is often leftover paint. This leftover paint is typically kept in its original paint can and stored at the home. As a result, many households possess numerous paint containers that are less than half full. This storage of old large paint containers is a waste of storage space. Furthermore, large old paint containers can be difficult to store. Most people stack old paint containers. Often these stacked containers can fall, and even pop open, which ruins the paint. Storage of old paint containers can lead to very inconvenient messes, and in general are unsightly. The inventor has realized that there is a difficulty in storing old paint containers and has realized that there is a need for a secure, clean, attractive storage means.

Another problem that the inventor has realized regarding storage of paint containers is that it can be difficult to determine which can holds which color. Many people choose to paint there exterior and interior of their home with a variety of colors and shades. Naturally, as a result, leftover paint comprises a multitude of colors that must be stored in separate containers. Apart from the inconvenience of having to open numerous cans to identify the desired color, the inventor has also realized that, in most instances, it is difficult to recreate the color. Trends in paint colors for exteriors and interiors of homes and other buildings change over time. In cases where a touch up is all that is needed, this does not create an insurmountable problem because it may, in most cases, be addressed using the amount of residual, leftover paint. However, in instances where a replacement coat of paint is desired, one can face a challenge remembering where the paint was purchased and the formula used to achieve the color. Accordingly, the inventor has also realized that there is a need for an easy, more convenient way to organize stored paint to retrieve a container holding a desired color, as well as cataloguing stored paint so that, when necessary, can be easily recreated.

DETAILED DESCRIPTION

Figure 1:
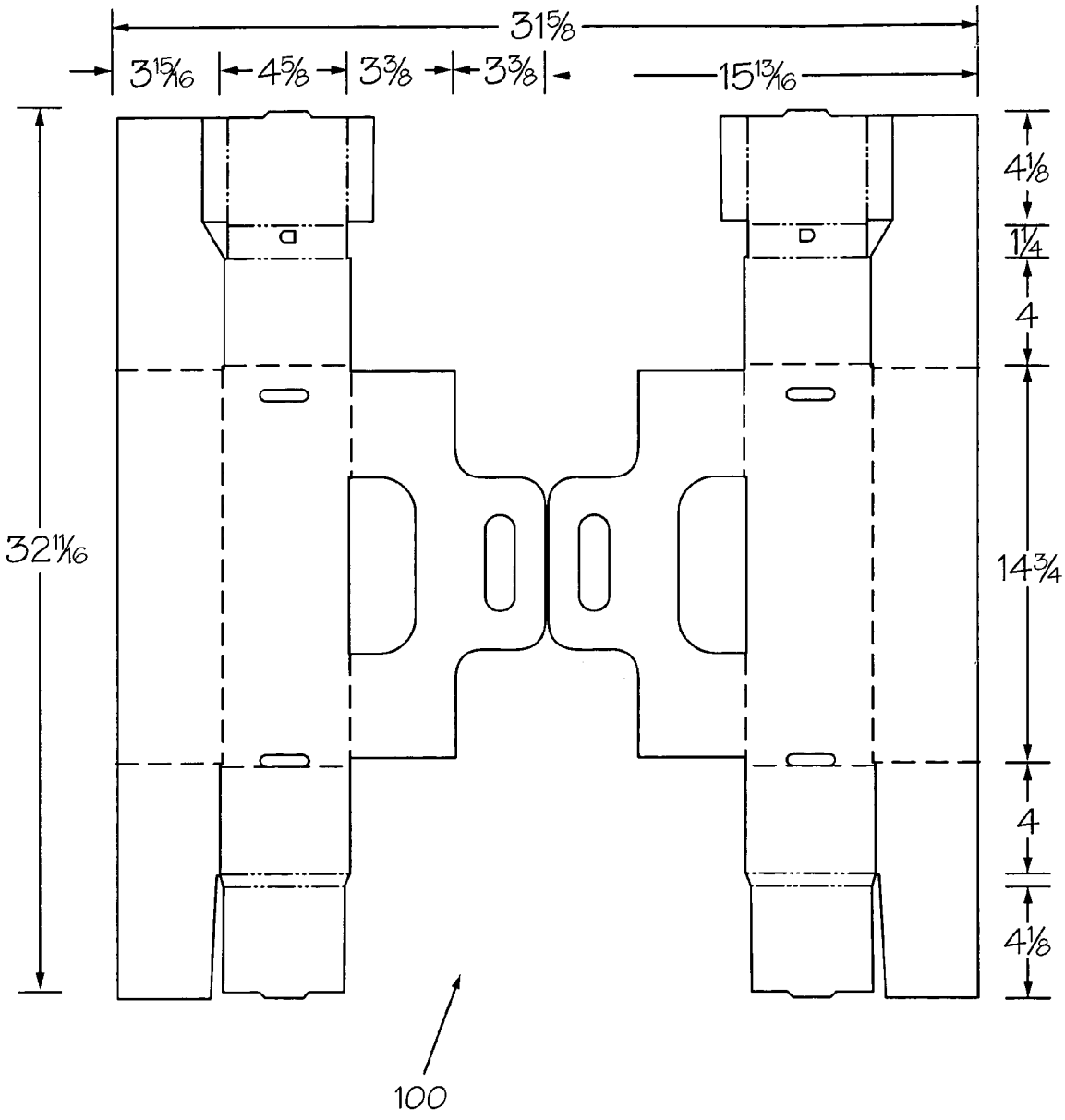
FIG. 1 shows a top view of an unfolded tray embodiment for use in a paint storing and cataloguing system.

The present invention is based on the inventor's discovery that there is a need for a way of storing, organizing and cataloguing leftover paint. According to one embodiment, the subject invention pertains to a tray designed for holding a plurality of containers. The tray is configured for securely stacking two or more such trays holding a plurality of containers. In one embodiment, the tray comprises two or more interconnected receptacles that are each designed for holding one or more containers. The tray also comprises a handle for easy lifting and transporting the tray using only one hand. Typically, the container is sized to hold an amount of material that is generally smaller than the amount in which the material was originally purchased. Typically, in the U.S., paint is sold in gallon size containers. Thus, container for use with certain embodiments of the subject system would be smaller than a gallon such as, but not limited to, liter size, quart size, pint size and the like. Preferably, the containers are quart-sized or less. Those skilled in the art will appreciate that the size of the containers may be adjusted as necessary to address the storage needs of a particular situation. However, the inventor has discovered that the quart-size containers provide a container size that is easy to manipulate, and which is typically large enough to hold leftover paint from a paint project. The term "leftover" as used herein in describing paint or some other substance refers to a substance that is transferred from a larger container to a smaller container.

In a further embodiment, the container used in conjunction with the tray embodiment comprises a form attached thereto with indicia, lines, and spaces to assist the user to record certain information about the paint being stored in such container. The form may contain indicia for recording information about which room or part of building correlates to the paint stored in the container, the name of the color, the date it was stored, the date it was purchased, the store from which it was purchased, the color code, and or the brand. Furthermore, the form may include an outlined space for placing a small amount of color onto the form to allow for the quick and easy recognition of which color is housed in the container. The inventor has found the foregoing information particularly helpful in cataloguing a particular paint, however, those skilled in the art, in view of the teachings herein, will readily appreciate that other data may be included or data excluded from the form depending on the situation.

The inventor has realized that there is a particular need in the home construction industry for a paint storage, organizing and cataloguing system. During the process of painting a new home, it is common for there to be several different colored paints leftover after the paint project. Some builders have made attempt to store leftover paints; but typically this, at most, amounts to putting the different individual colored paints into separate smaller containers and provide them in a box. This process does not provide a usable system for storing the paints; the paint cans are not labeled, they are not secured and can be tossed around in the box.

In light of the need by homebuilders and new homeowners for a simple, secure, system for storing paint, the inventor has discovered that the paint storage system provides a marketing opportunity for the builder. Marketing products or services to a consumer, such as and gaining repeat business has become more difficult as an increasing number of companies sacrifice innovation for financial stability by offering competing products having substantially similar features and specifications.

Today, differentiating a product, innovating, and engaging the customer on an emotional level are the keys to a successful marketing plan (Ealey, L. and L. Troyano-Bermudez, *The McKinsey Quarterly,* 1996 (4):62-75). Traditional "face-to-face, or "one-on-one" selling time with a buyer continues to decline in both quantity and quality. Without some constant reminder, and more particularly a reminder that draws attention to itself, the client may fail to recommend the product, or select it over a similar competing product when re-ordering.

In an effort to increase product awareness, businesses often use promotional items. The art of making and using promotional items is well established. It is a subset of general advertising and marketing in which a physical object, at times a sample of the actual product, rather than paper print advertising, is provided to a customer or a potential customer. These items typically include calendars, pens, magnets, caps, key chains and the like. However, items traditionally used are usually simple products that are only capable of marketing a product in a discreet manner. These gifts often provide little motivation for continued use by the consumer, and therefore minimize their effectiveness as a marketing tool.

It is axiomatic that in the field of advertisement/marketing, perception is often reality. Thus, a novel promotional item may make an immediate and indelible positive first impression, whereas the presentation of an ordinary, nondescript promotional item may actually foreclose future business opportunities. The most unique, practical and appealing promotional products will be the ones remembered and the ones most likely to increase customer goodwill, referral & repeat business. A consumer will likely be appreciative of receiving a promotional item, particularly if it has a secondary function that enables its continued use and solves a need. The most successful promotional products are capable of establishing brand recognition by reinforcing a visual message, even when the consumer is not engaged in an activity normally associated with the products use. Through repeat use of the item, the consumer will be reminded of the underlying product or service, thereby increasing the likelihood of repeat business or referrals. The more useful the promotional item, the more likely it will be remembered. In the context of building services, contracting services, painting services, and home repair services, the provision of an attractive tray for neatly storing leftover paints will undoubtedly make a good impression on the owner of a new home, or a newly painted home.

Following the first impression, the consumer will be reminded of the marketing information provided whenever the consumer needs to use the paints, or is working around where the paint storage system is being stored. The chances of the consumer choosing the services promoted in the advertisement certainly will be increased. Accordingly, in one embodiment the tray may comprise two or more side walls comprising a surface area for displaying marketing information of a service or product to be advertised.

Figure 2:
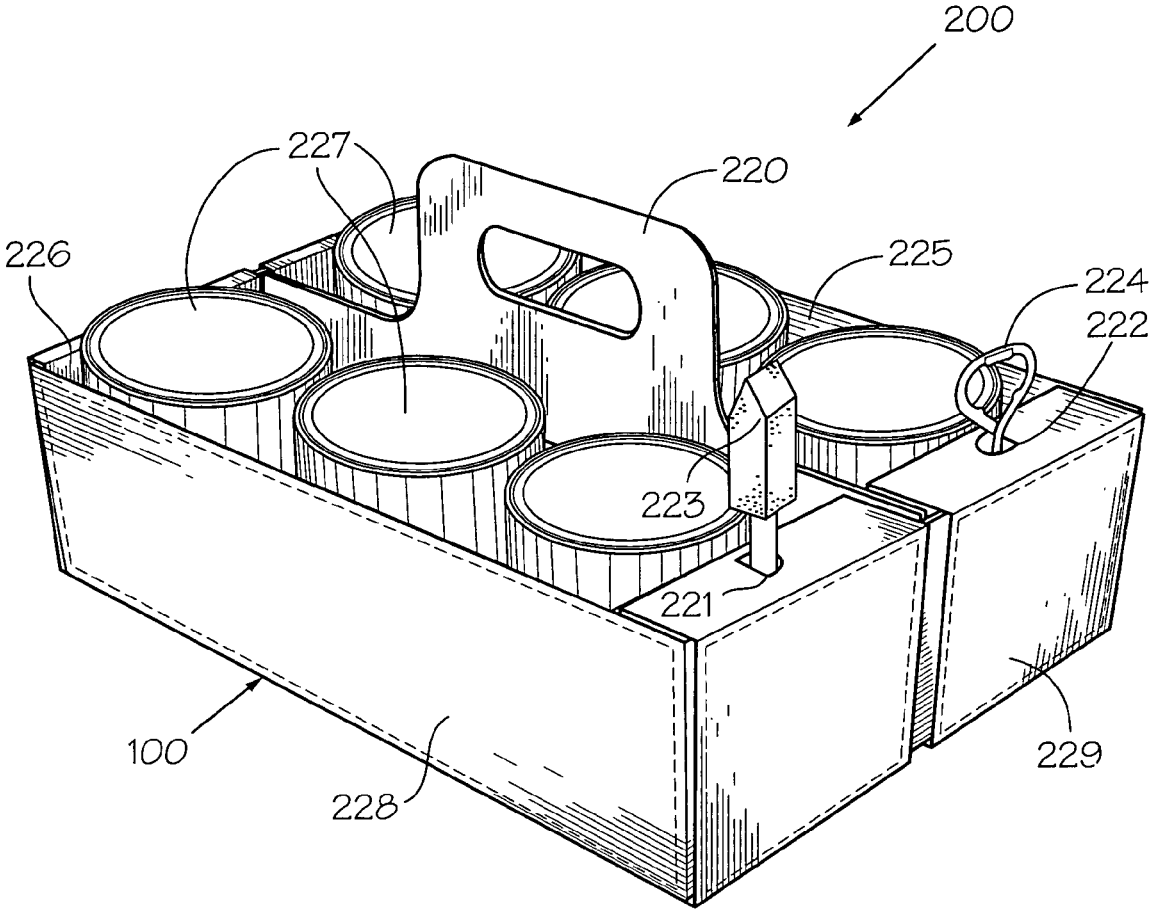
FIG. 2 shows a perspective view of a paint storing, organizing and cataloguing system embodiment.

FIG. 1 shows a tray embodiment 100 useful for storing and organizing paint. The tray embodiment 100 may be made of a material that is able to be bent and thereby foldable into the intended folded configuration. The dimension numbers shown on the unfolded tray are representative on an embodiment of the invention, and in no way meant to be limiting. The dimensions of the unfolded tray embodiment 100 may be adjusted to suit the desired need, and shape and sizes and number of containers that will be held by the tray 100. These adjustments will be readily understood and made by those skilled in the art in light of the teachings herein. FIG. 2 shows a paint storage, organizing and cataloguing system 200 comprising the tray embodiment 100 of FIG. 1 in its folded configuration. The tray 100 comprises a handle 220 generally located in the center of the tray embodiment 100 so that the tray 100 may be lifted with one hand. The tray 100 may have integrated into one or more of its walls or other structures a place for holding paint related tools and utensils. Shown in FIG. 2, the tray 100 comprises first and second holders 221, 222 integrated into its end walls for holding a sponge brush 223 and a paint can opener 224, respectively. The tray contains a first receptacle area 225 and a second receptacle area 226 each sized to hold three containers 227. The side walls 228 and end walls 229 may provide a surface for displaying marketing information (see dashed boxes).

In a preferred embodiment, the tray is configured in such a way that two or more trays of similar configuration are securely stackable on top of the other. Thus, the tray may comprise a protrusion on its top side and a receiver on its bottom side. When one tray is stacked on the other, the protrusion is positioned into the receiver. Naturally, those skilled in the art will appreciate other configurations for securely stacking one or more trays. For example, the inverse of the above mentioned configuration may be provided, i.e., a protrusion on the tray's bottom side and a receiver on the tray's top side.

Figure 3:
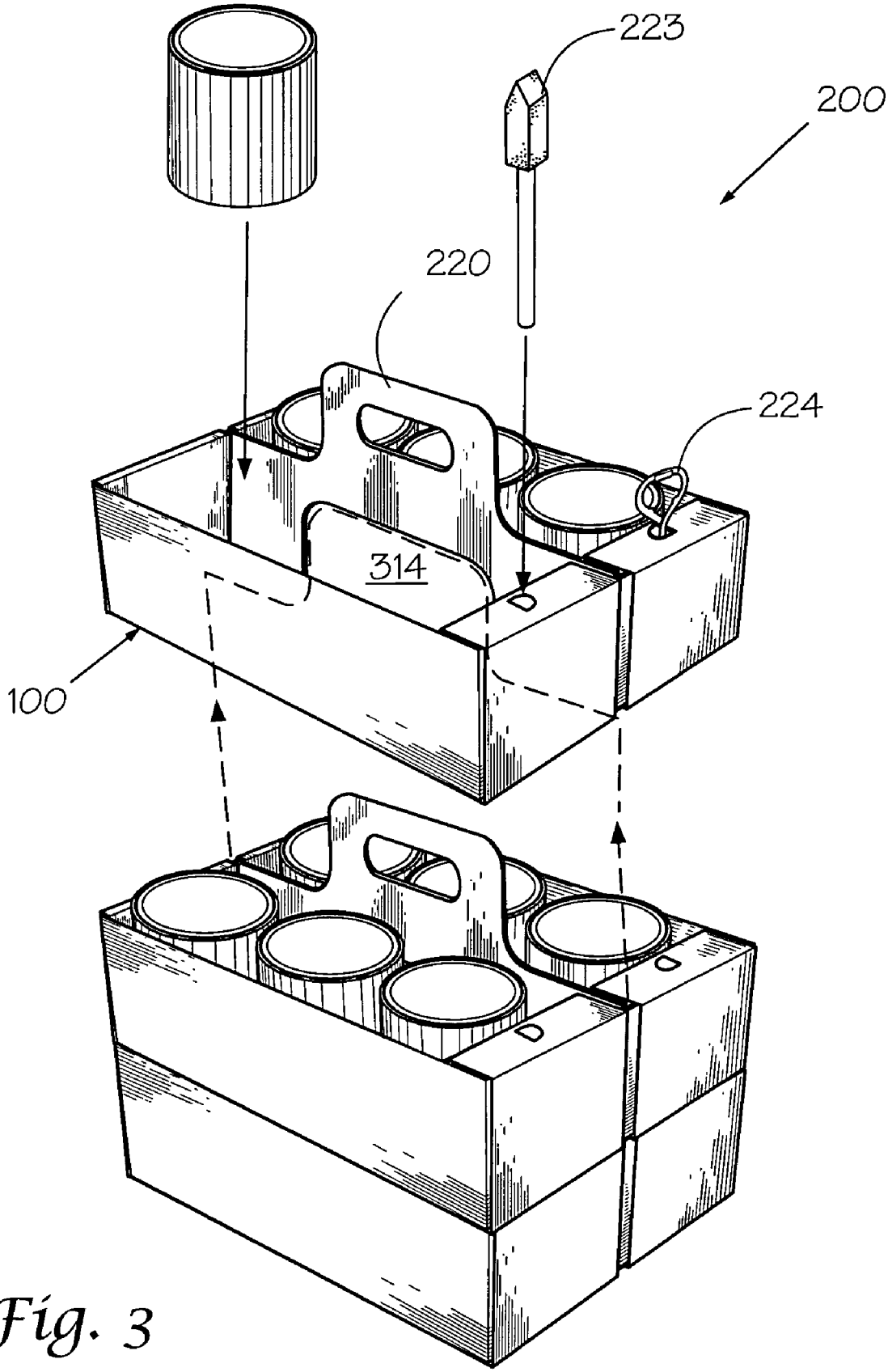
FIG. 3 shows a perspective view of a paint storing, organizing and cataloguing system embodiment.

FIG. 3 shows a perspective view of three system embodiments 200 as shown in FIG. 2 being stacked on top of each other. The handle 220 of the tray embodiments 100 act as protrusion which fits into a receiver 314 (see dashed line) which comprises a space or opening under the handle. Also, the utensils 223, 234 may be taken out and stored in the receptacle, or the tray 100 may comprise an opening under the holder 221, 222 into which the utensils may be inserted as the individual trays 100 are stacked.

Figure 4:
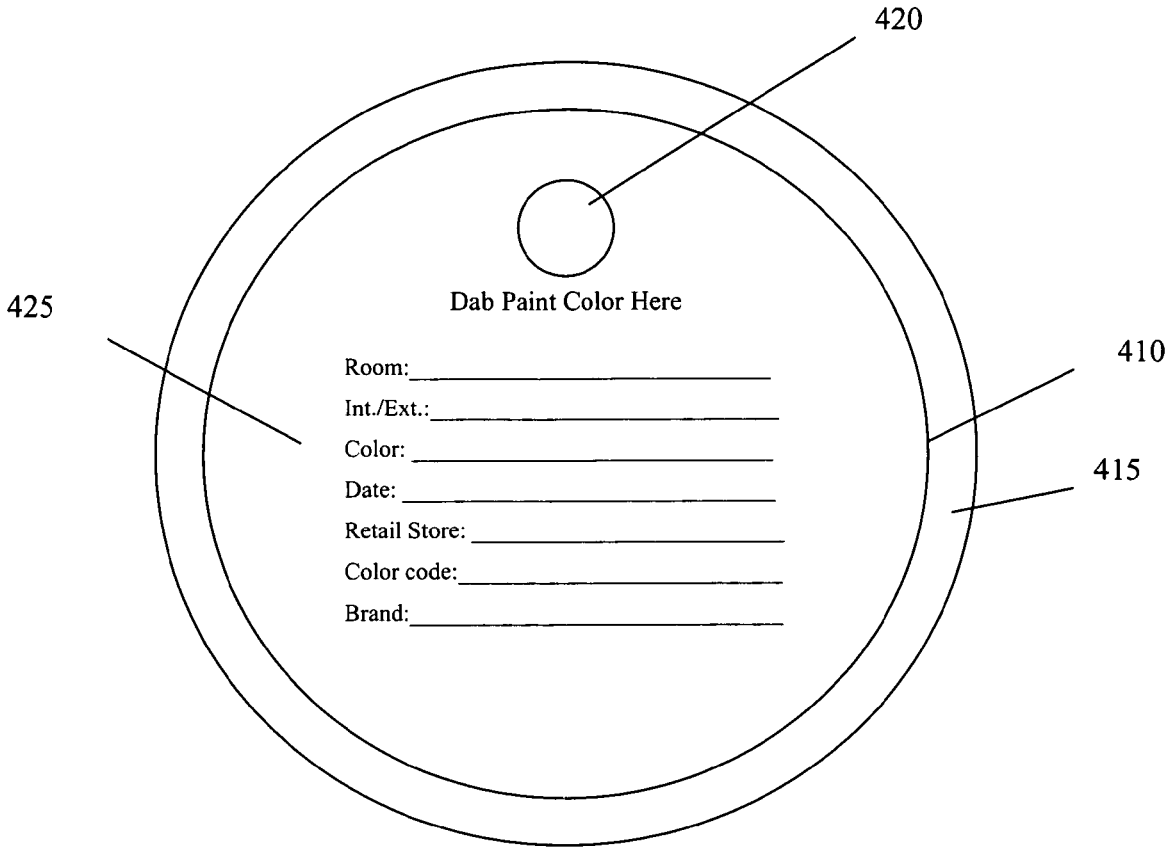
FIG. 4 shows a cataloguing form embodiment attached to a container top.

FIG. 4 shows a top view of a container top 415 which has affixed thereto a catalogue form 410 for inputting information about the substance housed in the container. The top 410 shown in FIG. 4 is one which would fit the container 227 shown in FIG. 2. The cataloguing form 415 comprises an outlined section 420 for placing a sample of the contained substance onto the form 415. The cataloguing form 415 also comprises a series of information inputting lines 425 which request certain information that will facilitate recollection of where the substance was used, purchased, and other information about the substance.

Typically, the tray is made of a corrugated wood-based material but also may be made of, but not limited to, plastic or other polymer material(s), metal, wood, glass or combinations thereof. The material may be configured so as to be foldable as discussed above so that it can morph from one form to another. In other embodiments, the tray may be made without folding such as through conventional construction techniques using any number of suitable materials, including those described above. The tray may also be assembled from two or more components, or formed into a continuous such as through use of conventional, widely used plastic or metal molding processes, such as injection molding.

Those skilled in the art will appreciate that in addition to storing paint, storage system embodiments may be employed to store any number of liquid or semi-liquid substances that may not be considered paint including but not limited sealers, glue, epoxy, insecticides, fertilizers, cleaning solutions, oil, etc. These other items may originally be purchased in a larger container and later transferred to a smaller container.

Finally, while various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims. The teachings of all patents and other references cited herein are incorporated herein by reference to the extent they are not inconsistent with the teachings herein.

What is claimed is:

1. A stackable system for storing containers of liquid or semi-liquid substances comprising:

a first tray comprising at least one protrusion extending from at least one portion of said first tray;

a second tray comprising at least one receiver for receiving said at least one protrusion, said first tray and said second tray being configured such that said at least one protrusion is inserted into said at least one receiver when said first tray is stacked on top of said second tray, or when said second tray is stacked on top of said first tray;

wherein said first tray and said second tray comprise at least one receptacle sized and configured for holding at least one container;

wherein said first tray and said second tray comprise a display area on an outer surface thereof having marketing information displayed thereon wherein said system further comprises a plurality of containers containing a leftover liquid or semi-liquid substance, at least one of said plurality of containers comprising a cataloguing form attached thereto.

2. The system of claim 1, wherein said second tray further comprises a protrusion extending from at least one portion thereof and said first tray comprises at least one receiver.

3. The system of claim 1, wherein said marketing information pertains to building, remodeling, and maintenance services.

4. The system of claim 1, wherein said plurality of containers contain paint and said cataloguing form comprises indicia, lines, spaces, or a combination thereof to assist the user to record certain information about the paint being stored in said plurality of containers.

5. The system of claim 4, wherein said cataloguing form comprises indicia for recording cataloguing information about paint stored in the container upon which said cataloguing form is attached; said cataloguing information comprising information about which room or part of a building in which the paint was used, the name of the color of paint, the date the paint was stored, the date the paint was purchased, the store from which the paint was purchased, the color code of the paint, or the brand of the paint, or a combination thereof.

6. The system of claim 1, wherein said cataloguing form comprises an outlined space for placing a small amount of paint onto said cataloguing form to allow for quick and easy recognition of which color is stored in the container upon which container said cataloguing form is attached.

7. The system of claim 1, wherein said first tray, second tray or both comprise at least one holder for holding a painting tool.

8. The system of claim 7, wherein said first tray, second tray or both comprise a tool receiver defined on a bottom side configured such that when said first and second tray are stacked, a portion of a tool disposed in said holder is inserted in said tool receiver.

9. The system of claim 1, wherein said first tray comprises a handle which comprises said at least one protrusion and said receiver of said second tray comprises an open space for receiving said handle.

* * * * *